US010463100B2

(12) United States Patent
Gotti

(10) Patent No.: US 10,463,100 B2
(45) Date of Patent: Nov. 5, 2019

(54) FOREHEAD SUPPORT BAND FOR HELMETS AND HELMET PROVIDED WITH SUCH FOREHEAD SUPPORT BAND

(71) Applicant: KASK S.p.A., Chiuduno (BG) (IT)

(72) Inventor: Angelo Gotti, Nembro (IT)

(73) Assignee: KASK S.P.A., Chiuduno (BG) (IT)

( * ) Notice: Subject to any disclaimer, the term of this patent is extended or adjusted under 35 U.S.C. 154(b) by 326 days.

(21) Appl. No.: 15/334,466

(22) Filed: Oct. 26, 2016

(65) Prior Publication Data

US 2017/0112222 A1 Apr. 27, 2017

(30) Foreign Application Priority Data

Oct. 27, 2015 (IT) ..... 102015000065806

(51) Int. Cl.

*A42B 3/08* (2006.01)
*A42B 3/28* (2006.01)
*A42B 3/14* (2006.01)

(52) U.S. Cl.

CPC ..... *A42B 3/08* (2013.01); *A42B 3/14* (2013.01); *A42B 3/283* (2013.01)

(58) Field of Classification Search

CPC ..... A42B 3/08; A42B 3/14; A42B 3/283
USPC ..... 2/421
See application file for complete search history.

(56) References Cited

U.S. PATENT DOCUMENTS 4,764,989 A * 8/1988 Bourgeois ..... A42B 3/185 2/10
6,199,214 B1 3/2001 Campbell
6,264,392 B1 * 7/2001 Wise ..... A42B 3/225 16/342
8,214,920 B1 7/2012 Edgar
2009/0241240 A1 10/2009 Han
2009/0293180 A1 12/2009 Grau
2011/0265236 A1 11/2011 Stoll
2012/0144565 A1 6/2012 Huh
2012/0291173 A1 11/2012 Gleason
2014/0053307 A1 2/2014 Cheng
(Continued)

FOREIGN PATENT DOCUMENTS

AU 3923468 A 12/1970
JP S6373323 U 5/1988
JP 2003064523 A 3/2003

OTHER PUBLICATIONS

Italian Search Report for Italian Application No. IO 59813 (2 Pages) (dated Jul. 6, 2016).
(Continued)

*Primary Examiner* — Gloria M Hale
(74) *Attorney, Agent, or Firm* — Lucas & Mercanti, LLP

(57) ABSTRACT

A forehead support band work or sports protective helmets is provided. The band has a structure which is elongated and flexible so as to assume an arched configuration in the mounted condition on a protective helmet. The structure has a first portion intended to permanently face, from the inside, the front part of a helmet on which the forehead support band is mounted and a second portion adapted to engage a user's forehead when the helmet is being used. The structure has an interspace interposed between the first portion and the second portion of the structure to help the aeration at the contact area between the forehead support band and the forehead of a user's head.

18 Claims, 5 Drawing Sheets

(56) References Cited

U.S. PATENT DOCUMENTS

| | | | | |
|---|---|---|---|---|
| 2014/0259286 | A1* | 9/2014 | Boyle | A41D 20/00 2/181 |
| 2015/0059057 | A1 | 3/2015 | Pfanner | |
| 2017/0112222 | A1* | 4/2017 | Gotti | A42B 3/08 |

OTHER PUBLICATIONS

Italian Search Report for Italian Application No. IO 59814 (2 Pages) (dated Jul. 6, 2016).
International Search Report for Italian Application No. IO59734 (2 Pages) (dated Jul. 6, 2016).
International Search Report for Italian Application No. IO 59765 (2 Pages) (dated Jul. 8, 2016).
International Search Report for Italian Application No. IO 59754 (2 Pages) (dated Jul. 8, 2016).

* cited by examiner

FOREHEAD SUPPORT BAND FOR HELMETS AND HELMET PROVIDED WITH SUCH FOREHEAD SUPPORT BAND

CROSS-REFERENCE TO RELATED APPLICATION

This application claims the benefit of Italian Patent Application No. 102015000065806 filed Oct. 27, 2015, the contents of which are incorporated herein by reference.

BACKGROUND OF THE INVENTION

The present invention relates to a forehead support band for helmets, in particular work protective helmets or sports helmets.

It is also an object of the present invention a helmet, in particular work or sports protective helmet, provided with such forehead support band.

The object of the present invention belongs to the field of helmets, headpieces and/or similar safety protective headgears which can be used during the performing of dangerous and risky activities, such as those carried out in construction sites, mines, oil platforms, by fire-fighters, by first aid providers, by mountain climbers or those carried out in any field where it is necessary to protect the head of the users. The object of the present invention is also suitable to be applied in the field of sports helmets, such as for example those intended for cycling, riding, skiing and for any other sports activity requiring the use of helmets.

As known, work protective helmets generally comprise a structure having at least one convex outer surface and at least one concave inner surface adapted to receive in engagement a user's head.

The inner surface is usually provided with a polystyrene protective shell for absorbing bumps and with possible paddings intended to improve the fit of such helmets.

In order to ensure the stability of the helmets on the head of the users, suitable headbands are also provided, developing almost completely along the whole profile of the concavity of the helmets on which they are applied for wrapping, in the operating condition of the latter, almost completely the head of the users.

The fixing of the above said headbands to the respective helmets is made by fixing a plurality of appendages developing on the upper part of the same. Such appendages are fixed directly to the inner surface of the respective helmet, whereby the respective headband remains suspended at the lower edge of the same.

In detail, the headband has a front portion intended to rest against the forehead of the user's head and side portions intended to adhere to the parietal areas of the user's head.

The headband is provided with one or more paddings intended to soften the contact between the same and the user's head. The paddings, which completely wrap the front portion of the headband, are generally applied to the headband by means of numerous adhesive or Velcro® elements.

Although work protective helmets with padded headbands, such as those described above, are widely used and ensure a good fit, the Applicant has found that, however, they aren't exempt from some drawbacks and can be improved under different aspects, mainly in relation to aeration or transpiration at the front portion of the headbands when they are resting on the forehead of the users, as well as in relation to the ease and velocity in removing, applying or replacing the padding from the headband.

In particular, the Applicant has found that the adhesion of the whole headband on the head of the users prevents, especially in the front part of the head of the users, the aeration of the parts in contact with the band.

Furthermore, the removal and the application of the paddings on the headband is complicated, hard and long to perform, whereby the removal for washing the padding or for its replacing with another new or different one isn't usually carried out due to the difficulties encountered during such operations.

SUMMARY AND OBJECTS OF THE INVENTION

The main purpose of the present invention is to provide a forehead support band for helmets and a helmet provided with such forehead support band, able to solve the problems observed in the known technique.

A further purpose of the present invention is to increase the aeration on the head of the users at the contact area between the helmet and their forehead.

A further purpose of the present invention is to facilitate and accelerate the operations of removing, applying or replacing the padding which softens the contact between the forehead and the band of the helmets.

The above specified and yet further purposes are substantially achieved by a forehead support band for helmets and a helmet provided with such forehead support band, as stated and described in the following claims.

There is now provided, by way of example, the description of a preferred but not exclusive embodiment of a forehead support band for helmets and a helmet provided with such forehead support band.

BRIEF DESCRIPTION OF THE DRAWINGS

Such description will be made herein below with reference to the accompanying drawings, provided for indicative purposes only and therefore not limiting, wherein.

DETAILED DESCRIPTION OF THE INVENTION

With reference to FIGS. 1 to 5 and 7 to 9, number 1 indicates generally a forehead support band for helmets, in particular work or sports protective helmets.

Figure 8:
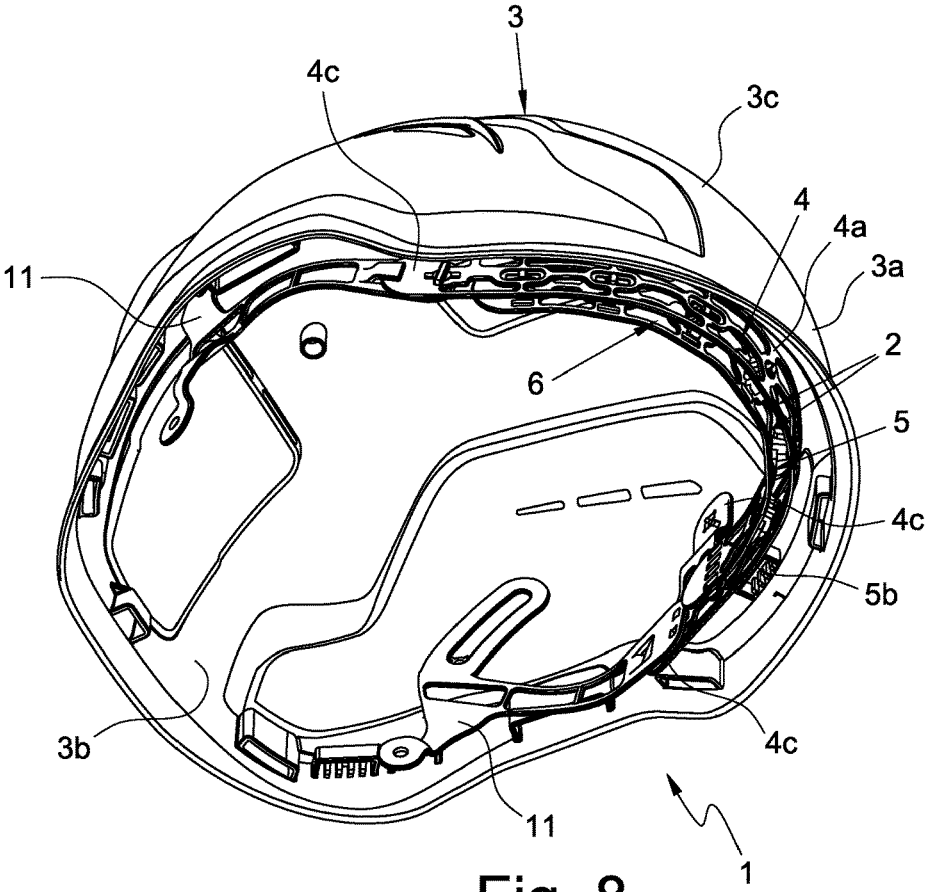
FIG. 8 is a perspective representation of a protective helmet provided with the forehead support band of FIGS. 1 to 5.
Figure 9:
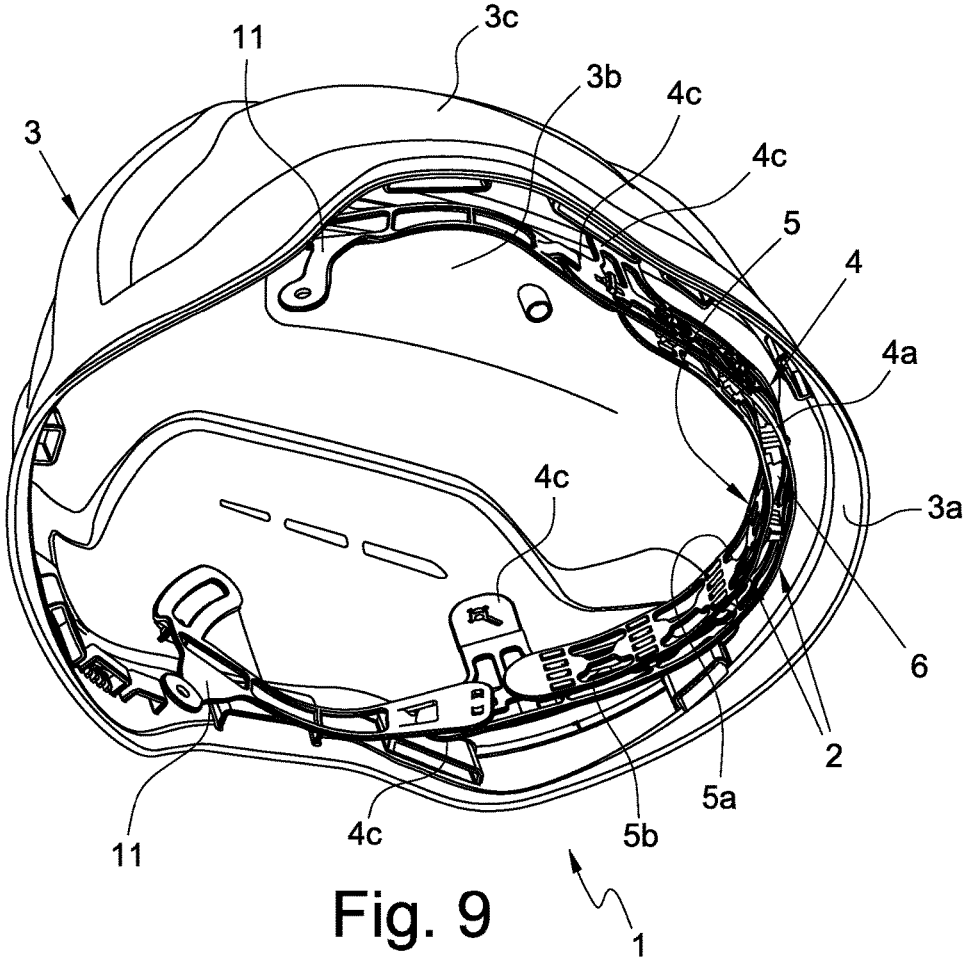
FIG. 9 is a further perspective representation of the protective helmet with the forehead support band illustrated in FIG. 8.

The forehead support band 1 comprises a structure 2 which is elongated and flexible so that it can assume an arched configuration in the mounted condition on a protective helmet 3 (FIGS. 8 and 9).

As can be seen in FIGS. 1 to 5 and 7 to 9, the structure 2 of the forehead support band 1 has a first portion 4 intended to permanently face the front part 3*a* of an inner 3*b* and outer 3*c* surface of a protective helmet 3 on which the forehead support band 1 is mounted and a second portion 5 (FIG. 6) adapted to engage a user's forehead when the helmet 3 is being used.

The structure 2 advantageously comprises at least one interspace 6 (FIGS. 1 to 4 and 7 to 9) interposed between the first portion 4 and the second portion 5 so as to help the aeration at the contact area of the forehead support band 1 on the forehead of the user wearing the protective helmet 3.

As can be seen in FIGS. 1 to 4 and 7 to 9, the interspace 6 extends along the longitudinal development of portions 4, 5 of the structure 2, preferably along at least half of the longitudinal development of the portions 4, 5 of the structure 2, more preferably along at least three quarters of the longitudinal development of the portions 4, 5 of the structure 2, even more preferably substantially along the entire longitudinal development of the portions 4, 5 of the structure 2.

The interspace 6 is obtained by means of at least one spacer element 7, preferably a plurality of optionally equally-spaced spacer elements 7, interposed between the portions 4, 5 of the structure 2.

As can be seen in FIGS. 1 to 4 and 7 to 9, the spacer elements 7 lie inside the interspace 6 when the portions 4, 5 of the structure 2 are mutually engaged. The spacer elements 7 are integrally joined to one of the portions 4, 5 of the structure 2, preferably to the second portion 5, and have—on the opposite side with respect to the portion 5 to which they are integrally joined—a support surface 7*a* for supporting the other portion 4 of the structure 2, preferably the first portion 4.

The dimensions of the spacer elements 7 determine substantially the distance present between the portions 4, 5 of the structure 2.

According to a preferred aspect of the present invention, the first portion 4 of the structure 2 has a substantially grid-shaped body 4*a*. The body 4*a* of the first portion 4 is provided with a plurality of aeration and lightening openings 4*b* which further help the passage of air.

Similarly, also the second portion 5 of the structure 2 has a substantially grid-shaped body 5*a*. The body 5*a* of the second portion 5 of the structure 2 has a plurality of aeration and lightening openings 5*b* which further help the passage of air.

Advantageously, the first and second portion 4, 5 of the structure 2 are removably engaged to one another, so that they can be separated when necessary.

In order to ensure the engagement and also the separation of the portions 4, 5 of the structure 2, the forehead support band 1 comprises engagement means 8 operatively interposed between the first portion 4 and the second portion 5.

Preferably, the engagement means 8 are of the snap-fit type, whereby the engagement of one portion 4, 5 of the structure 2 to the other can be performed by pressing such portions 4, 5 against one another, whereas the disengagement of the portions 4, 5 of the structure 2 can be performed by pulling at least one portion away from the other.

Figure 1:
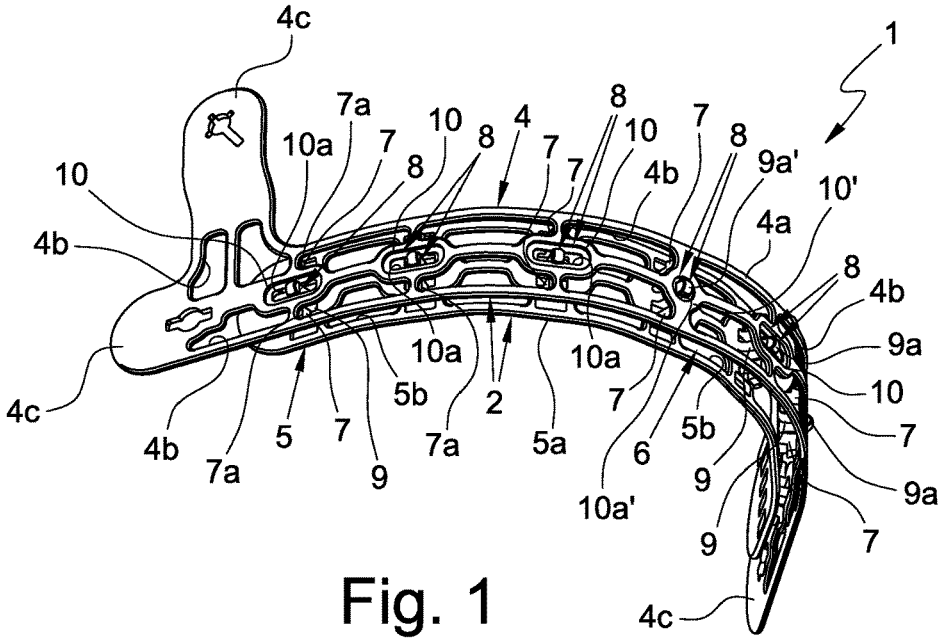
FIG. 1 is a perspective view of a forehead support band for safety helmets, represented in an arched configuration corresponding substantially to the configuration in the mounted condition on a safety helmet or while being used.
Figure 2:
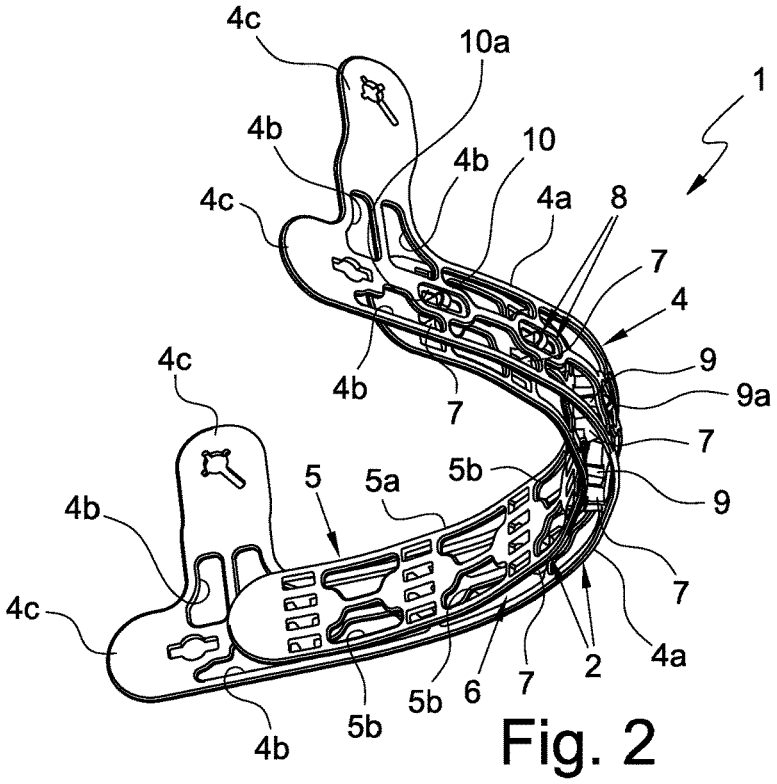
FIG. 2 is a further perspective view of the forehead support band of FIG. 1, represented in the same configuration.
Figure 3:
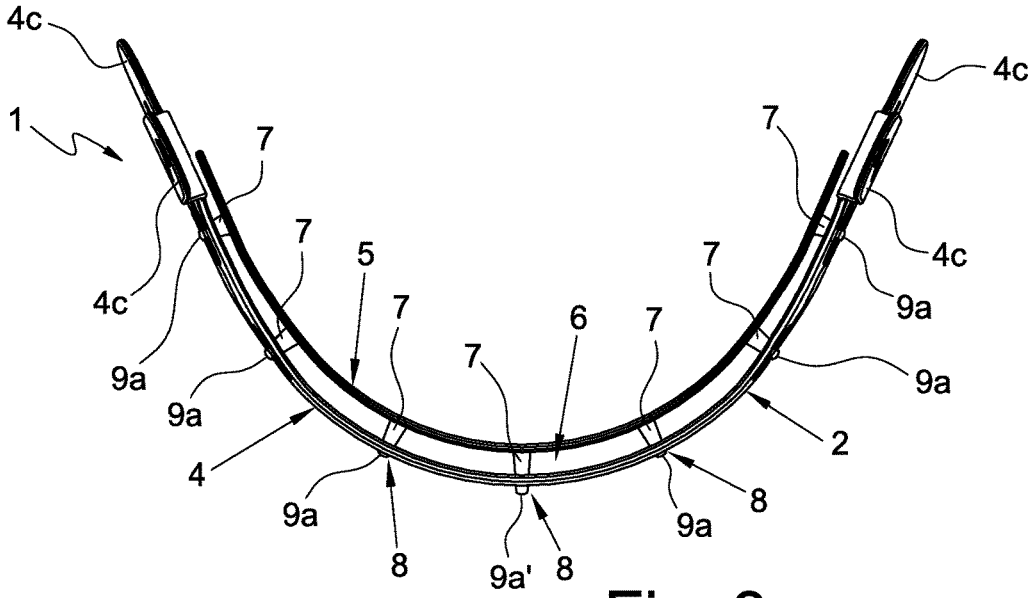
FIG. 3 is a top view of the forehead support band of the previous figures.
Figure 4:
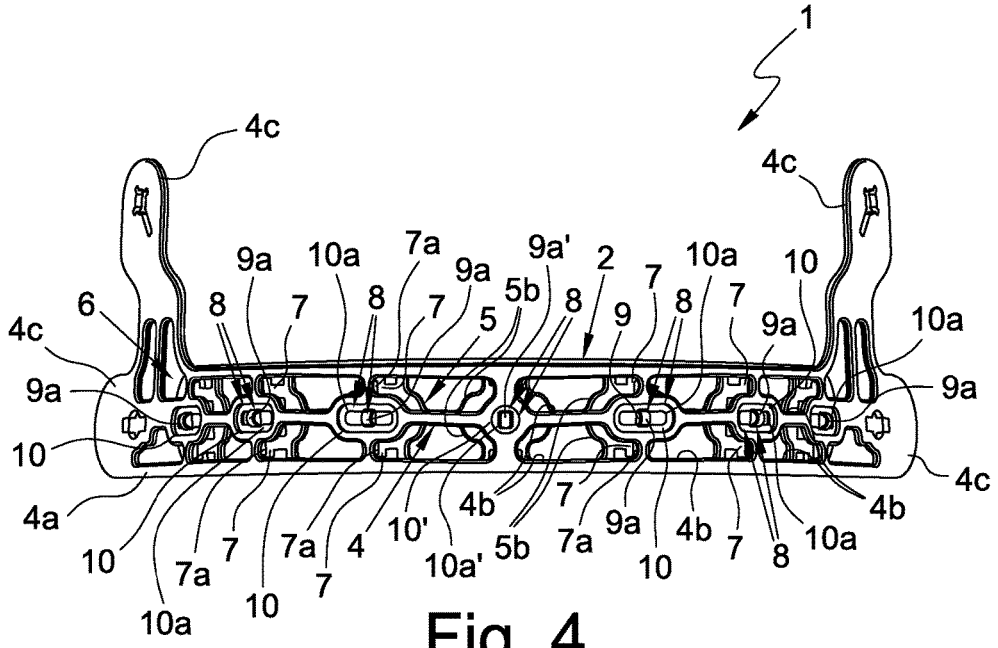
FIG. 4 is a front view of the forehead support band of the previous figures.
Figure 5:
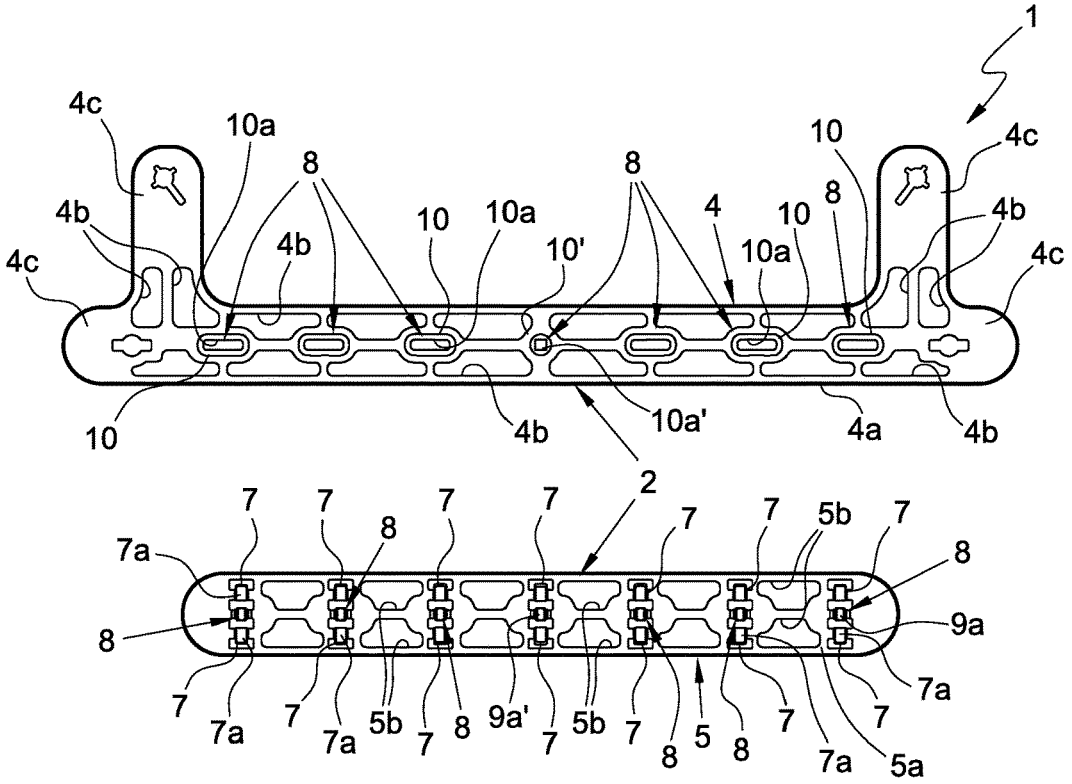
FIG. 5 is a plan representation of the components of the band of the previous figures.
Figure 6:
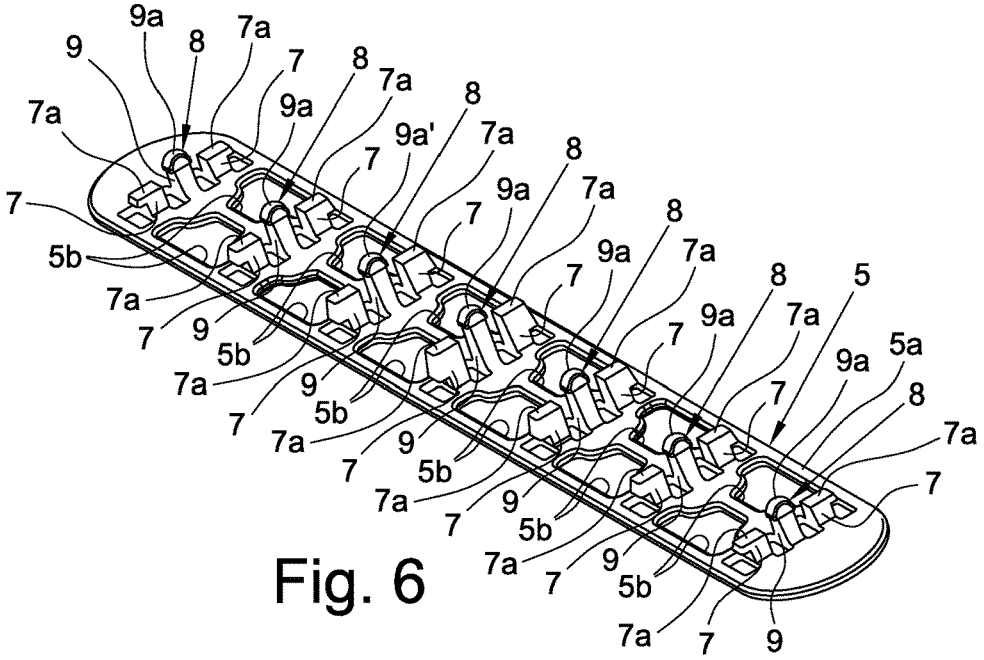
FIG. 6 is a perspective view of a component of the band illustrated in FIGS. 1 to 5.
Figure 7:
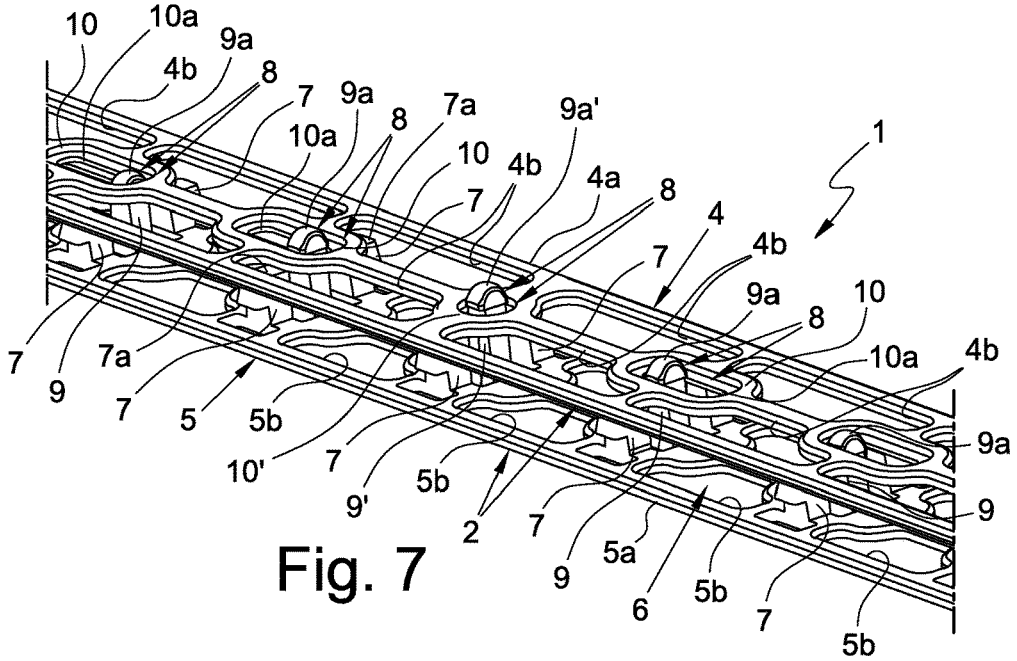
FIG. 7 is an enlarged representation of a detail of the forehead support band illustrated in FIGS. 1 to 3.

As can be seen in FIGS. 3 to 5, the engagement means 8 comprise at least one protrusion 9 having one coupling portion 9*a* (FIG. 7) having enlarged section and at least one seat 10 having one elastically yielding coupling edge 10*a*. The protrusion 9 is insertable into the seat 10 and is removable therefrom thanks to the yielding capacity of the coupling edge 10*a* of the seat 10.

In detail, the engagement means 8 comprise a plurality of protrusions 9 each having at least one coupling portion 9*a* having enlarged section and a plurality of seats 10 each having one elastically yielding coupling edge 10*a*. Each protrusion 9 is inserted into or removed from the respective seat 10 by a force able to elastically deform the coupling edge 10*a* of the respective seat 10.

Each protrusion 9 of the engagement means 8 is integrally joined with one of the portions 4, 5 of the structure 2, preferably the second portion 5, and each seat 10 of the engagement means 8 is obtained in the body 4*a*, 5*a* of the other portion 4, 5, preferably the first portion 4.

As can be seen in FIGS. 4 to 7, the protrusions 9 and the seats 10 of the engagement means 8 are distributed along the longitudinal development of the portions 4, 5, preferably according to equally-spaced positions.

Preferably, the protrusions 9 and the seats 10 of the engagement means 8 are present in an odd number.

In this case, the engagement means 8 comprise a centring protrusion 9' and a centring seat 10' each arranged respectively at the midpoint of the respective portion 4, 5 of the structure 2.

Advantageously, the coupling edge 10*a*' of the centring seat 10' delimits an opening for the respective centring protrusion 9' that does not allow such centring protrusion 9' to move transversely, i.e. it does not allow the centring protrusion 9' to slide along the longitudinal development of the portions 4, 5 of the structure 2.

In accordance with a further preferred aspect of the present invention, the seats 10 of the engagement means 8 arranged on one side and on the other one with respect to the centring seat 10' define, on the body 4*a* of the respective portion 4 of the structure 2, respective slots that develop along the longitudinal development of the respective portion 4.

Advantageously, each slot allows the sliding of the respective protrusion 9 along the longitudinal development of the portions 4, 5 of the structure 2, thereby allowing the switching of the latter and, therefore, of the forehead support band 1 from a substantially straight condition to an arched condition.

Advantageously, the forehead support band 1 comprises at least one padding sheath (not illustrated in the attached figures) that is engageable, preferably in a fitted manner, on the second portion 5 of the structure 2 so as to have a soft support surface for the forehead of the user wearing the protective helmet 3. The padding sheath has a structure which allows the engagement of the protrusions 9 to the seats 10 of the engagement means 8, as well as the formation of the interspace 6 for the aeration of the user's forehead.

As can be seen in FIGS. 1 to 5 and 7 to 9, the first portion 4 of the structure 2 comprises a plurality of fixing portions 4*c* for the direct or indirect fixing of the forehead support band 1 to the protective helmet 3 by means of intermediate elements 11 (FIGS. 8 and 9). The forehead support band and the protective helmet provided with the same according to the present invention solve the problems observed in the prior art and achieve important advantages.

Firstly, the presence of an interspace between the portions forming the structure of the forehead support band allows to increase the aeration at the contact area between such band and the user wearing the helmet, with considerable benefits for the latter.

Furthermore, the quick coupling and uncoupling system of the portions of the structure allows to remove, apply and replace the padding present on the second portion, in an easy, quick and practical manner.

The invention claimed is:

1. A helmet comprising a structure having at least one substantially convex outer surface and at least one substantially concave inner surface adapted to receive a user's head in engagement, the helmet comprising at least one forehead support band comprising:

an elongated structure capable of assuming an arched configuration in a mounted condition on the helmet, the structure having a first portion intended to permanently face, from inside, a front part of the helmet on which the forehead support band is mounted and a second portion adapted to engage a user's forehead when the helmet is being used;

least one interspace interposed between the first portion and the second portion of the structure to facilitate an aeration at a contact area between the forehead support band and the forehead of a user's head;

engagement means operatively interposed between the first portion and the second portion of the structure in order to allow both the joining of such portions so as to define the interspace and the disengagement of the portions, when necessary, the engagement means being of a snap-fit type, whereby the engagement of a portion of the structure to another portion of the structure can be performed by pressing the portions of the structure against one another, whereas the disengagement of the portions of the structure can be performed by pulling at least one portion away from the other.

2. A helmet according to claim 1, wherein the interspace extends at least half the longitudinal development of the first portion and the second portion of the structure.

3. A helmet according to claim 1, wherein the interspace extends along at least three quarters of the longitudinal development of the first portion and the second portion of the structure.

4. A helmet according to claim 1, wherein the interspace extends entire longitudinal development of the first portion and the second portion of the structure.

5. A helmet according to claim 1, wherein the interspace extends along a longitudinal development of the first portion and the second portion of the structure.

6. A helmet according to claim 1, wherein the first portion of the structure has a substantially grid-shaped body, the body of the first portion of the structure having a plurality of aeration and lightening openings.

7. A helmet according to claim 1, wherein the second portion of the structure has a substantially grid-shaped body, the body of the second portion having a plurality of aeration and lightening openings.

8. A helmet according to claim 1, wherein the interspace is obtained by means of at least one spacer element, interposed between the first portion and the second portion of the structure, the spacer elements lying inside the interspace when the first portion and the second portion of the structure are mutually engaged.

9. A helmet according to claim 7, wherein the spacer elements are integrally joined to one of the first and second portions of the structure, on the opposite side with respect to the portion to which the elements are integrally joined, such elements have a support surface for supporting the other portion of the structure not integrally joined to the elements, the spacer elements determining a distance between the first portion and the second portion of the structure.

10. A helmet according to claim 1, wherein the engagement means comprise:

at least one protrusion having at least one coupling portion having enlarged section; and at least one seat having an elastically yielding coupling edge, the protrusion being insertable into the seat and being removable therefrom by exploiting a yielding capacity of the coupling edge of the seat.

11. A helmet according to claim 10, wherein the engagement means comprise:

a plurality of protrusions each having at least one coupling portion having enlarged section;

a plurality of seats each having an elastically yielding coupling edge, each protrusion being insertable into a respective seat and being removable therefrom by exploiting the yielding capacity of the coupling edge of the latter.

12. A helmet according to claim 11, wherein each protrusion of the engagement means is integrally joined with one of the portions of the structure, preferably the second portion and each seat of the engagement means is obtained in a body of the other portion.

13. A helmet according to claim 12, wherein the protrusions and the seats of the engagement means are distributed along the longitudinal development of the first portion and the second portion.

14. A helmet according to claim 11, wherein the protrusions and the seats of the engagement means are present in an odd number.

15. A helmet according to claim 11, wherein the engagement means comprise a protrusion and a centring seat each arranged at a midpoint of the respective portion of the structure, the coupling edge of the centring seat delimiting an opening for a respective centring protrusion that does not allow such centring protrusion to move transversely.

16. A helmet according to claim 15, wherein the seats of the engagement means arranged on one side and on the other one with respect to the centring seat define, on the body of the respective portion of the structure, respective slots that develop along the longitudinal development of the respective portion, each slot allowing the sliding of the respective protrusion in order to allow the switching of the forehead support band between a substantially straight condition and an arched condition.

17. A helmet according to claim 1, comprising at least one padding sheath that can be fitted on the second portion of the structure so as to have a soft support surface for supporting a user's forehead, the padding sheath allowing the engagement of the protrusions to the seats of the engagement means and the forming of the aeration interspace.

18. A helmet according to claim 1, wherein the first portion of the structure has a plurality of fixing portions for the direct or indirect fixing to a respective helmet by means of intermediate elements.

* * * * *